US007757655B2

(12) United States Patent
Inui et al.

(10) Patent No.: US 7,757,655 B2
(45) Date of Patent: Jul. 20, 2010

(54) CRANKCASE STRUCTURE FOR AN INTERNAL COMBUSTION ENGINE

(75) Inventors: Hiroatsu Inui, Saitama (JP); Hiromi Sumi, Saitama (JP); Eiji Kittaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 476 days.

(21) Appl. No.: 11/902,656

(22) Filed: Sep. 24, 2007

(65) Prior Publication Data

US 2008/0257298 A1 Oct. 23, 2008

(30) Foreign Application Priority Data

Sep. 26, 2006 (JP) ..... 2006-261277

(51) Int. Cl.
*F02B 75/22* (2006.01)
*F02B 75/00* (2006.01)

(52) U.S. Cl. ..... 123/195 R; 123/195 AC

(58) Field of Classification Search ..... 123/195 R, 123/195 AC; 180/219, 226, 230; 29/888.01
See application file for complete search history.

(56) References Cited

U.S. PATENT DOCUMENTS 4,339,964 A * 7/1982 Isaka ..... 180/219

FOREIGN PATENT DOCUMENTS

JP 2670109 B2 4/1990

* cited by examiner

*Primary Examiner*—Noah Kamen
(74) *Attorney, Agent, or Firm*—Birch, Stewart, Kolasch & Birch, LLP

(57) ABSTRACT

A crankcase structure of an internal combustion engine has a desirable shaft support achieved by maintaining the strength of a side wall of a crankcase at a high level without increasing the weight and the size of the internal combustion engine even when the internal combustion engine has an output shaft projecting from the crankcase. A crankcase structure has a crankshaft and a counter shaft that are rotatably supported on a partitioning plane of a crankcase. A main shaft is oriented in the fore-and-aft direction and is rotatably supported on opposed front and rear walls of either one of the upper and lower crankcases. An output shaft to be driven by a power of the counter shaft penetrates through the front and rear walls of one of the upper and lower crankcases by which the main shaft is not rotatably supported, and projects to the front and rear.

20 Claims, 6 Drawing Sheets

CRANKCASE STRUCTURE FOR AN INTERNAL COMBUSTION ENGINE

CROSS-REFERENCE TO RELATED APPLICATIONS

This nonprovisional application claims priority under 35 U.S.C. §119(a) on Patent Application No. 2006-261277, filed in Japan on Sep. 26, 2006, the entirety of which is incorporated herein by reference.

BACKGROUND OF THE INVENTION

1. Field of the Invention

The present invention relates to a crankcase structure of an internal combustion engine.

2. Background of the Invention

In an internal combustion engine, a crank shaft and a counter shaft are rotatably supported on a partitioning plane by being sandwiched between an upper crankcase and a lower crankcase of a crankcase configured to have upper and lower halves. A main shaft is rotatably supported by the upper crankcase. Output members such as an output sprocket or an output gear are fitted to an end portion of the counter shaft projecting outward from the crankcase, to drive a rear wheel via a chain, or to drive an output shaft through meshing of gears.

An example of such internal combustion engine is disclosed in Japanese Patent No. 2670109. In a crankcase of an internal combustion engine disclosed in Japanese Patent No. 2670109, opposed left and right walls rotatably support the main shaft and the counter shaft. A rear wheel drive sprocket is fitted to the left end of the counter shaft which penetrates through the left wall. A left bearing opening on the left wall, which rotatably supports the left end of the main shaft via a bearing, is also an opening for removing the main shaft and hence has a large inner diameter.

The left wall of the crankcase, on which the bearing opening of a large diameter for the main shaft is formed, includes a bearing opening in which the counter shaft is rotatably supported via the bearing. The left bearing opening for supporting the counter shaft is located near the rear wheel drive sprocket and hence is subject to a large load. Therefore, the counter shaft must be rotatably supported robustly with a large bearing. However, the left bearing opening for supporting the main shaft is formed adjacent to the left bearing opening for supporting the counter shaft on the left wall of the crankcase.

As described above, the left bearing opening for supporting the main shaft has a large inner diameter for removing the main shaft, and the left bearing opening for supporting the counter shaft formed adjacent thereto also has to be formed to have a large inner diameter for fitting the large bearing. Therefore, it is difficult to maintain the strength of the left wall of the crankcase in the periphery of the rear wheel drive sprocket, which is to be fitted to the counter shaft.

In the internal combustion engine having the output shaft which projects from the front and rear of the crankcase for driving a front wheel or a rear wheel, the output shaft penetrates through the crankcase. Hence, the internal combustion engine tends to be increased in weight and size because the thickness is increased in order to secure the strength of the crankcase.

SUMMARY OF THE INVENTION

In view of the above problems, it is an object of the present invention to provide a crankcase structure of an internal combustion engine in which the strength of a side wall of a crankcase is maintained at a high level without increasing the weight and the size of the internal combustion engine to desirably support shafts, even when the internal combustion engine is provided with an output shaft that projects from the crankcase.

In order to achieve the object described above, a first aspect of the present invention is directed to a crankcase structure of an internal combustion engine in which a crankshaft and a counter shaft are rotatably supported on a partitioning plane of a crankcase including upper and lower halves oriented in the fore-and-aft direction. A main shaft oriented in the fore-and-aft direction is rotatably supported on opposed front and rear walls of either one of the upper and lower crankcases. An output shaft oriented in the fore-and-aft direction to be driven by a power of the counter shaft penetrates through the front and rear walls of one of the upper and lower crankcases by which the main shaft is not rotatably supported, and projects to the front and rear.

According to a second aspect of the present invention, a bearing opening for rotatably supporting the counter shaft via a bearing is formed on the one side wall at a position in the proximity of an output member provided at an end of the counter shaft projecting outward from the one of the opposed front and rear walls. A bearing recess for rotatably supporting one end of the main shaft via a first bearing is formed on the one side wall adjacent to the bearing opening for rotatably supporting the counter shaft. A bearing opening for rotatably supporting the other end of the main shaft via a second bearing is formed on the other side wall, which opposes the one side wall, so as to have an inner diameter larger than a transmission gear at the outer most end of the other end on the main shaft.

According to a third aspect of the present invention, the main shaft includes an inner cylinder and an outer cylinder rotatably fitted to a part of the inner cylinder. One end of the inner cylinder is rotatably supported by the bearing recess on the one side walls via the first bearing. The other end of the inner cylinder is rotatably supported together with the outer cylinder by the bearing opening on the other side wall via the second bearing.

According to a fourth aspect of the present invention, the main shaft is inserted into the bearing opening on the other side wall and the one end of the inner cylinder is rotatably supported by the bearing recess on the one side wall via the first bearing. Then, the second bearing is fitted between the outer cylinder rotatably fitted to a predetermined position of the inner cylinder and the bearing opening of the other side wall from the outside, so that the main shaft is assembled.

According to a fifth aspect of the present invention, a pair of transmission clutches for controlling transmission of power to the outer cylinder and the inner cylinder respectively are assembled respectively to the outside portion of the outer cylinder that projects outward from the bearing opening of the other side wall and the outside portion of the inner cylinder that projects further outward from the outer cylinder.

According to the first aspect of the present invention, the crankshaft and the counter shaft are rotatably supported on the partitioning plane of the crankcase including the upper and lower halves oriented in the fore-and-aft direction. The main shaft oriented in the fore-and-aft direction is rotatably supported on the opposed front and rear walls of either one of the upper and lower crankcases. Therefore, the lateral width of the internal combustion engine may be reduced by arranging the crankshaft, the main shaft and the counter shaft at the respective apexes of a triangle. The output shaft penetrates through the front and rear walls of one of the upper and lower crankcases by which the main shaft is not rotatably supported, and projects to the front and rear. Therefore, the shaft support of the crank case may be dispersed. Hence, shaft support may be achieved desirably without upsizing the internal combustion engine.

According to the second aspect of the present invention, the bearing opening for rotatably supporting the other end of the main shaft via the second bearing is formed on the other side wall so as to have an inner diameter larger than the transmission gear at the outermost end of the other end on the main shaft. The bearing opening of the other side wall of the crankcase is used as an opening for assembling the main shaft. Therefore, the main shaft having the transmission gear group assembled thereto may be inserted into the bearing opening to achieve assembly of the main shaft and the assembleability of the main shaft may desirably be secured.

Therefore, it is not necessary to use the bearing recess for rotatably supporting the one end of the main shaft via the first bearing at one end as the opening for assembling the main shaft and hence the inner diameter may be reduced. Therefore, even when the bearing opening for rotatably supporting the counter shaft formed adjacent thereto is formed to have a large diameter for fitting the large bearing for resisting a load applied to the output members, the strength of the side wall of the crankcase in the periphery of the output members may be maintained at a high level.

According to the third aspect of the present invention, the one end of the main shaft of the inner cylinder having a small diameter is rotatably supported by the bearing recess of the one side wall via the first bearing. Therefore, the inner diameter of the bearing recess may be reduced. Hence, the strength of the side wall of the crankcase in the periphery of the output members provided on the counter shaft may be maintained at a higher level.

According to the fourth aspect of the present invention, the main shaft is inserted into the bearing opening of the other side wall and the one end of the inner cylinder is rotatably supported by the bearing recess on the one side wall via the first bearing. Then, the second bearing is fitted between the outer cylinder rotatably fitted to a predetermined position of the inner cylinder and the bearing opening of the other side wall from the outside, so that the main shaft is assembled. The assembling work of the main shaft may be desirably achieved.

According to the fifth aspect of the present invention, the pair of transmission clutches for controlling transmission of power to the outer cylinder and the inner cylinder respectively are assembled respectively to the outside portion of the outer cylinder that projects outward from the bearing opening of the other side wall and the outside portion of the inner cylinder that projects further outward from the outer cylinder. Therefore, the pair of transmission clutches may be assembled to the outer portion of the outer cylinder and the outer portion of the inner cylinder projecting outward from the crankcase. Hence, assembly of the transmission clutches may be achieved easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
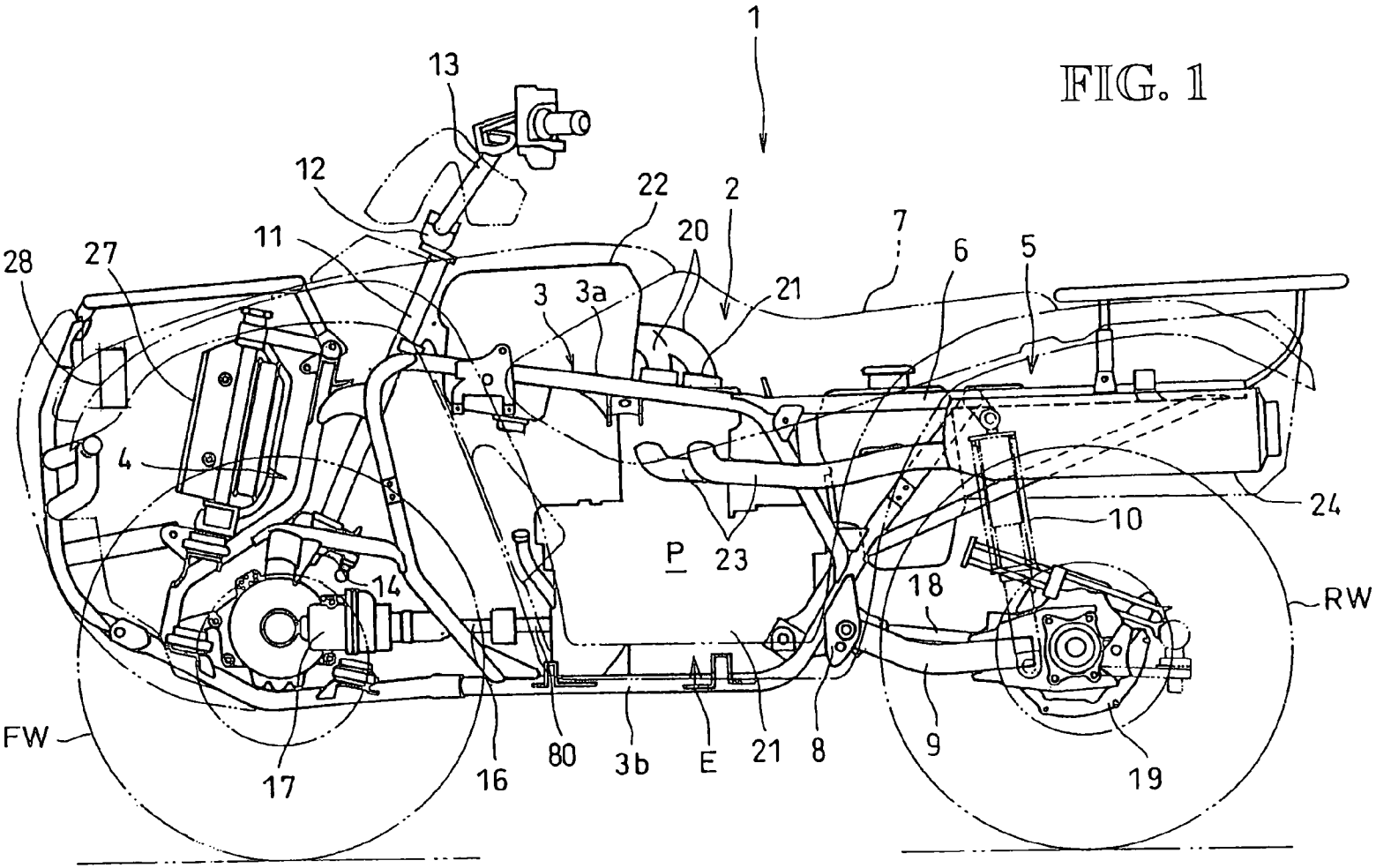
FIG. 1 is a side view of a rough-terrain traveling vehicle in which a power unit according to an embodiment of the present invention is mounted with a vehicle body cover or the like removed.

The present invention will now be described in detail with reference to the accompanying drawings, wherein the same reference numerals will be used to identify the same or similar elements throughout the several views. It should be noted that the drawings should be viewed in the direction of orientation of the reference numerals.

Figure 2:
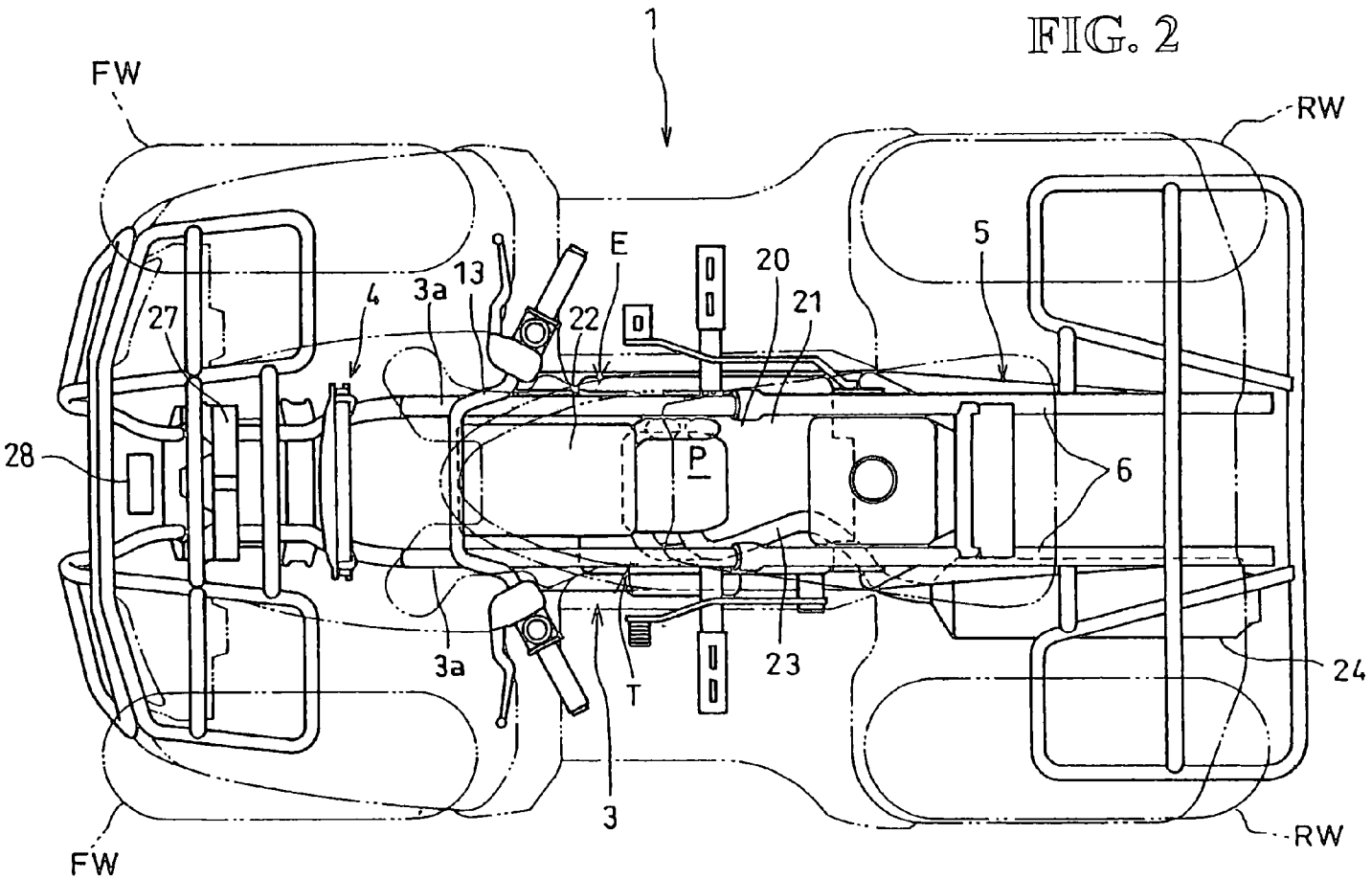
FIG. 2 is a plan view of the same.

Referring now to FIG. 1 to FIG. 6, an embodiment of the present invention will be described. A side view of a rough-terrain traveling vehicle 1 in which a water-cooled internal combustion engine E according to this embodiment is mounted with a vehicle body cover or the like removed is shown in FIG. 1. A plan view of the same is shown in FIG. 2. In this embodiment, the front, rear, left and right are defined on the basis of the direction of travel of the vehicle.

The rough-terrain traveling vehicle 1 is a saddle type four-wheel vehicle, and a pair of left and right front wheels FW on which low-pressure balloon tires for rough-terrain are mounted and a pair of left and right rear wheels RW on which the same balloon tires are mounted are suspended in the front and rear of a vehicle body frame 2.

The vehicle body frame 2 is configured with a plurality of types of steel material joined together. The vehicle body frame 2 includes a center frame portion 3, on which a power unit P having the internal combustion engine E and a transmission T provided integrally in a crankcase 31 is supported. A front frame portion 4 is connected to the front portion of the center frame portion 3 for suspending the front wheels FW. A rear frame portion 5 is connected to the rear portion of the center frame portion 3 and has a seat rail 6 for supporting a seat 7.

The center frame portion 3 includes: a pair of left and right upper pipes 3*a* and a pair of left and right lower pipes 3*b*. The upper pipes 3*a* each substantially form three sides by being bent downward at a front and rear thereof. The lower pipes 3*b* each substantially form one side to form substantially a rectangular shape in side view. The left and right pipes are connected by a cross member.

Swing arms 9 whose front ends are supported rotatably via a shaft by pivot plates 8 fixed to portions of the lower pipes 3*b* extend obliquely upward at the rear end thereof. Rear cushions 10 are provided between the rear portion of the swing arms 9 and the rear frame portion 5. The rear wheels RW are suspended by rear final reduction gear units 19 provided at the rear ends of the swing arms 9.

A steering column 11 is supported at the lateral center of the cross member extending between the front end portions of the left and right upper pipes 3*a*. A steering handle 13 is connected to the upper end portion of a steering shaft 12 steerably supported by the steering column 11. The lower end portion of the steering shaft 12 is connected to a front wheel steering mechanism 14.

The internal combustion engine E of the power unit P is a water-cooled two-cylinder internal combustion engine and is mounted to the center frame portion 3 with a crankshaft 30 oriented in the fore-and-aft direction of a vehicle body, that is, in a so-called vertical posture.

The transmission T of the power unit P is arranged on the left-hand side of the internal combustion engine E. An output shaft 80 oriented in the fore-and-aft direction projects toward the front and rear from the transmission T at a position which is displaced toward the left. Therefore, a rotational force of the output shaft 80 is transmitted from the front end of the output shaft 80 to the left and right front wheels FW via a front drive shaft 16 and a front final reduction gear unit 17, and is transmitted from the rear end thereof to the left and right rear wheels RW via rear drive shafts 18 and the rear final reduction gear units 19.

A radiator 27 is supported in the front frame portion 4 of the vehicle body frame 2, and an oil cooler 28 is disposed in front thereof.

Figure 3:
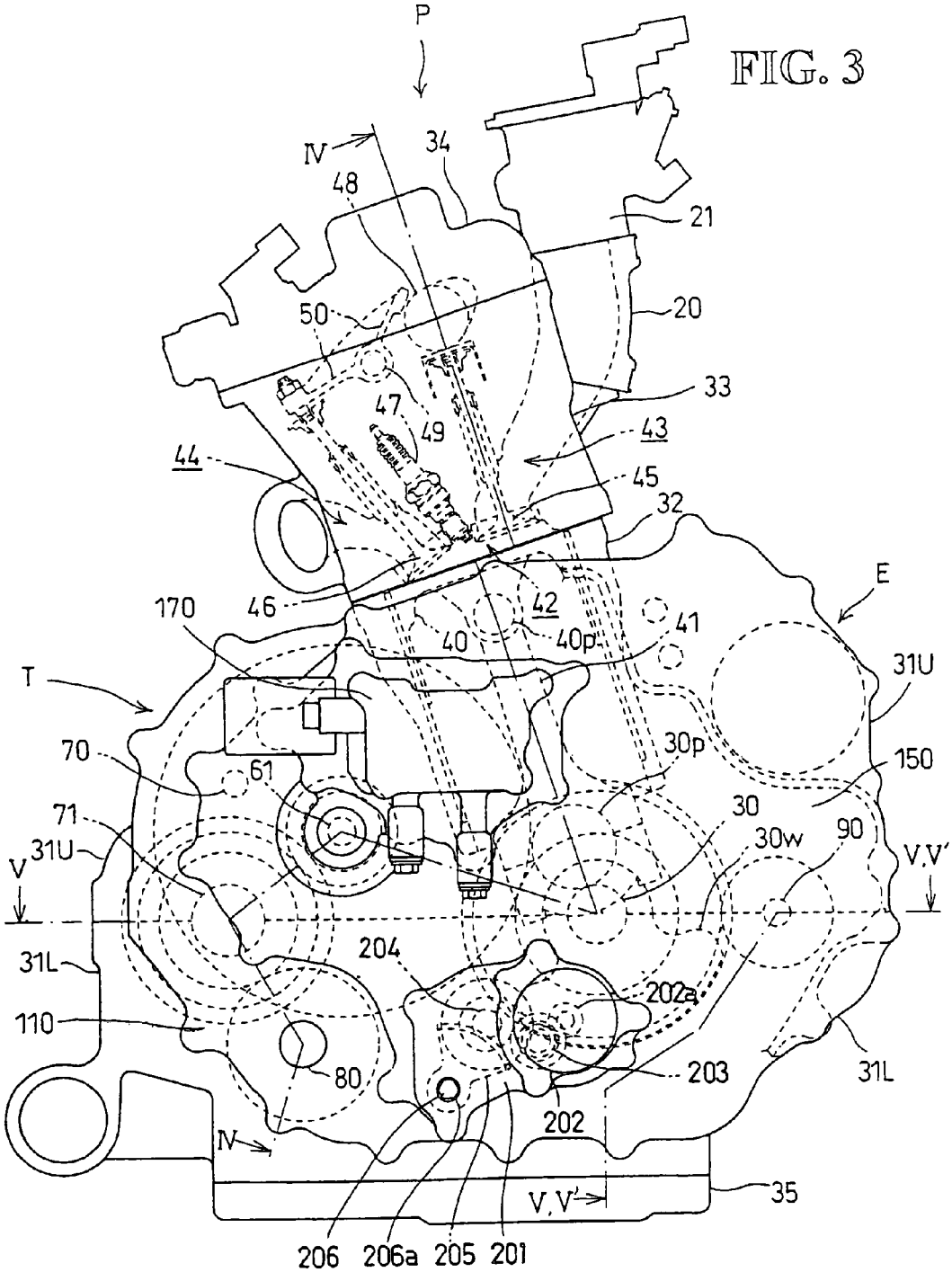
FIG. 3 is a rear view of the power unit.

Referring to FIG. 3, which is a rear view of the power unit P, the crankcase 31 that contains the internal combustion engine E and the transmission T of the power unit P in the interior thereof has a vertically divided structure divided into upper and lower halves, that is, an upper crankcase 31U and a lower crankcase 31L, along a plane including the crankshaft 30.

A cylinder block portion 32 formed integrally with the upper crankcase 31U at the upper portion thereof with two cylinder bores 32*c* arranged in series are formed so as to incline slightly toward the left and extend upward. A cylinder head 33 is placed on the top of the cylinder block portion 32. The cylinder head 33 is covered with a cylinder head cover 34.

On the other hand, an oil pan 35 is attached to the bottom of the lower crankcase 31L.

Curved air-intake pipes 20 extending substantially upward from a right wall of the cylinder head 33 are connected to an air cleaner 22 arranged above the internal combustion engine E with the intermediary of a throttle body 21. A curved exhaust pipe 23 extending rearward from a left wall of the cylinder head 33 is connected to an exhaust muffler 24 attached on the left-hand side of the rear frame portion 5.

Figure 4:
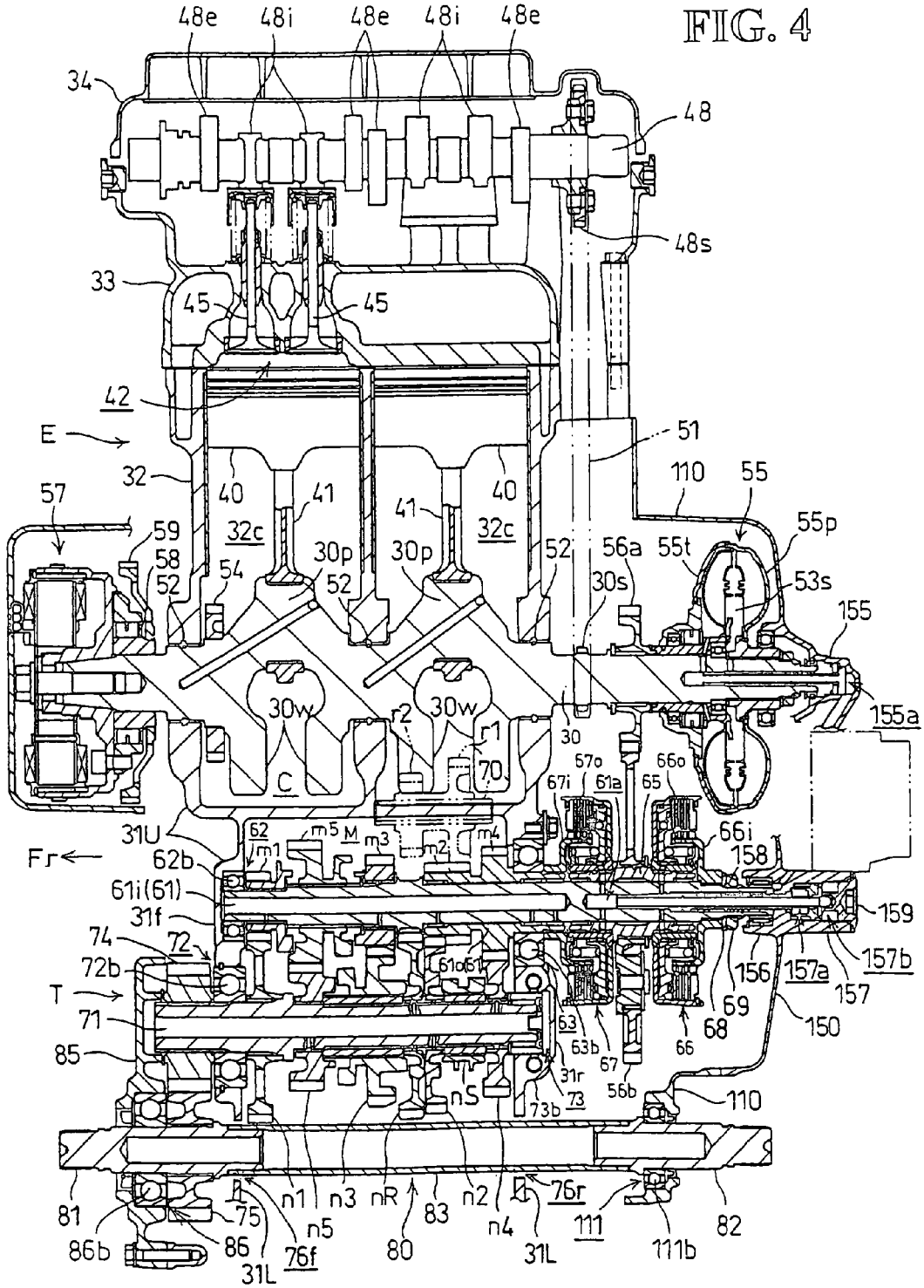
FIG. 4 is a developed cross-sectional view of the power unit (taken along the line IV-IV in FIG. 3)

Referring now to FIG. 3 and FIG. 4, pistons 40 are fitted to the two cylinder bores 32*c* of the cylinder block portion 32 so as to be capable of reciprocating. Crank pins 30*p* between crank webs 30*w*, 30*w* of the crankshaft 30 and piston pins 40*p* of the pistons 40 are connected by connecting rods 41. Therefore, a crank mechanism is configured.

In the cylinder head 33, each cylinder bore 32*c* includes: a combustion chamber 42 opposing the pistons 40; an air-intake port 43 opening into the combustion chamber 42 and extending rightward and upward so as to be opened and closed by a pair of air-intake valves 45; exhaust ports 44 extending forward so as to be opened and closed by a pair of exhaust valves 46; and ignition plugs 47 mounted thereto so as to be exposed into the combustion chamber 42. The air-intake pipes 20 are connected to the air-intake ports 43.

The upper ends of the air-intake valves 45 come into abutment with air-intake cam lobes 48*i* of a camshaft 48, which is rotatably supported by the cylinder head 33 via a shaft. One end of a rocker arm 50 rotatably supported by a rocker arm shaft 49 via a shaft comes into abutment with exhaust cam lobes 48*e* of the camshaft 48. The upper ends of the exhaust valves 46 come into abutment with the other ends of the rocker arms 50.

Therefore, the air-intake valves 45 and the exhaust valves 46 open and close the air-intake ports 43 and the exhaust ports 44 synchronously with the rotation of the crankshaft 30 by the camshaft 48 at a predetermined timing. In order to do so, the camshaft 48 is fitted with a cam sprocket 48*s* at the rear portion thereof. A timing chain 51 is wound between a drive sprocket 30*s* fitted to the portion of the crankshaft 30 near the rear end portion thereof and the cam sprocket 48*s* (see FIG. 4), so that the camshaft 48 is driven to rotate at half a revolving speed of the crankshaft 30.

The crankshaft 30 is rotatably supported by being clamped between the upper crankcase 31U and the lower crankcase 31L via a plane bearing 52. As shown in FIG. 4, the rear portion of the crankshaft 30 that projects rearward from a crank chamber is formed with the drive sprocket 30*s*. A primary drive gear 56*a* is provided on further rear ends thereof via a fluid coupling 55 as a fluid joint. The fluid coupling 55 includes a pump impeller 55*p* fixed to the crankshaft 30, a turbine runner 55*t* opposed thereto, and a stator 53*s*.

The primary drive gear 56*a* is joined with the turbine runner 55*t*, which is rotatable with respect to the crankshaft 30. The power from the crankshaft 30 is transmitted to the primary drive gear 56*a* via hydraulic oil. The primary drive gear 56*a* meshes with a primary driven gear 56*b*, which is rotatably supported by a main shaft 61, described later, and transmits the rotation of the crankshaft 30 to the main shaft 61 side.

On the other hand, a starting driven gear 59 is supported by the front side portion of the crankshaft 30 projecting forward from a crank chamber C via an AC generator 57 and a one way clutch 58. A balancer shaft drive gear 54 is fitted to a portion of the crankshaft 30 extending along the inner surface of the front wall of the crank chamber C.

A transmission chamber M is defined by being partitioned by a partitioning wall in the left side of the crank chamber C that accommodates the crank webs 30*w* of the crankshaft 30.

A transmission gear mechanism 60 accommodated in the transmission chamber M is a constantly engaging gear mechanism, in which the main shaft 61 is supported by the upper crankcase 31U at a position leftward and obliquely upward of the crankshaft 30. A counter shaft 71 located in left side of the crankshaft 30 is supported on a partitioning plane by being sandwiched between the upper and lower crankcases 31U, 31L at a position leftward and obliquely downward of the main shaft 61 (see FIG. 3).

The main shaft 61 includes an inner cylinder 61*i* and an outer cylinder 61*o*, which rotatably fits on part of the inner cylinder 61*i*. The front end of the inner cylinder 61*i* is rotatably supported by a bearing recess 62 formed on a front wall 31*f* of the transmission chamber M of the upper crankcase 31U with the intermediary of a first bearing 62*b*. The outer cylinder 61*o* is fitted on the inner cylinder 61*i* substantially at a center position on the rear side so as to be capable of relative rotation. Part of the outer cylinder 61*o* is rotatably supported by a bearing opening 63 formed on a rear wall 31*r* of the transmission chamber M with the intermediary of a second bearing 63*b* and is supported together with the inner cylinder 61*i*.

The outer cylinder 61*o* is integrally formed with a second transmission drive gear m2 and a fourth transmission drive gear m4 at the front and rear respectively on a portion inside the second bearing 63*b*. The outer portion projects partly outward from the second bearing 63*b*.

On the inner cylinder 61*i*, a first transmission drive idle gear m1, a fifth transmission drive gear m5 formed integrally with a shifter and spline-fitted to the inner cylinder 61*i*, and a third transmission drive idle gear m3 in sequence from the front on the front side of the second and fourth transmission drive gears m2 and m4 on the outer cylinder 61*o* are rotatably supported. The outer portion of the inner cylinder 61*i* projects further rearward from the outer portion of the outer cylinder 61*o*.

The bearing recess 62 formed on the front wall 31*f* is formed to have a small inner diameter for rotatably supporting the front end of the inner cylinder 61*i* having a small diameter. The bearing opening 63 formed on the rear wall 31*r* is formed to have an inner diameter larger than the diameter of the fourth transmission drive gear m4 at the rear end. The bearing opening 63 is used for assembly of the main shaft 61.

The bearing opening 63 on the rear wall 31*r* of the transmission chamber M has an inner opening end formed with an inwardly extending flange 63*f* projecting slightly toward the center axis. The inner diameter of the flange 63*f* is larger than the diameter of the fourth transmission drive gear m4.

An input sleeve 65 is rotatably fitted on the outer portion of the inner cylinder 61*i* in juxtaposition with the outer cylinder 61*o*. The primary driven gear 56*b* is fitted at the center of the input sleeve 65, so that the primary driven gear 56*b* meshes with the primary drive gear 56*a* on the side of the crankshaft 30.

A first transmission clutch 66 is assembled to the input sleeve 65 at a position rearwardly of the primary driven gear 56*b*. A second transmission clutch 67 is assembled thereto at a position forwardly of the primary driven gear 56*b*. A pair of the first transmission clutch 66 and the second transmission clutch 67 are hydraulic multiple disc friction clutches having the same structure.

The first transmission clutch 66 includes a cup-shaped clutch outer 66*o* opening rearward integrally fitted to the input sleeve 65, and a clutch inner 66*i* integrally fitted to the internal cylinder 61*i*. On the other hand, the second transmission clutch 67 includes a cup-shaped clutch outer 67*o* opening forward integrally fitted to the input sleeve 65 and a clutch inner 67*i* integrally fitted to the outer portion of the outer cylinder 61*o*.

When hydraulic pressure is supplied to the first transmission clutch 66 and hence the clutch outer 66*o* and the clutch inner 66*i* are connected, the rotation of the input sleeve 65 which is integral with the primary driven gear 56*b* is transmitted to the rotation of the second and fourth transmission drive gears m2, m4 of the outer cylinder 61*o*. When hydraulic pressure is not supplied, the clutch outer 66*o* and the clutch inner 66*i* are disconnected and the rotation is not transmitted to the second and fourth transmission drive gears m2 and m4 of the outer cylinder 61*o*.

In the same manner, when the hydraulic pressure is supplied to the second transmission clutch 67 and hence the clutch outer 67*o* and the clutch inner 67*i* are connected, the rotation of the input sleeve 65 which is integral with the primary driven gear 56*b* is transmitted to the inner cylinder 61*i*. Hence, the fifth transmission drive gear m5 spline-fitted to the inner cylinder 61*i* is rotated. When the hydraulic pressure is not supplied, the clutch outer 67*o* and the clutch inner 67*i* are disconnected. Hence, the rotation is not transmitted to the fifth transmission drive gear m5 on the inner cylinder 61*i*.

The counter shaft 71 supported on a partitioning plane by being sandwiched between the upper and lower crankcases 31U, 31L at a position leftward and obliquely downward of the main shaft 61 as described above is rotatably supported at the front portion by a bearing opening 72 formed on the front wall 31*f* of the transmission chamber M via a bearing 72*b*, and is rotatably supported at the rear end thereof by a bearing recess 73 formed on the rear wall 31*r* of the transmission chamber M via a bearing 73*b*.

A first transmission driven gear n1, a fifth transmission driven idle gear n5, a third transmission driven gear n3 formed integrally with the shifter and spline-fitted to the counter shaft 71, a reverse idle gear nR, a second transmission driven idle gear n2, a shifter nS, a fourth transmission driven idle gear n4 are arranged and supported rotatably by the counter shaft 71 via a shaft in sequence from the front in the transmission chamber M. The corresponding transmission drive gear and the transmission driven gear are constantly meshed with each other.

A reverse idle shaft 70 is disposed at a position above the counter shaft 71 (see FIG. 3 and FIG. 4). A reverse large diameter gear r1 and a reverse small diameter gear r2 are supported by the reverse idle shaft 70 so as to rotate integrally. The reverse large diameter gear r1 meshes with the second transmission drive gear m2 on the main shaft 61. The reverse small diameter gear r2 meshes with the reverse idle gear nR on the counter shaft 71.

The fifth transmission drive gear m5 on the main shaft 61 and the third transmission driven gear n3 on the counter shaft 71 are shifter gears. The two shifter gears and the shifter nS on the counter shaft 71 are shifted in the axial direction by the transmission drive mechanism so that the transmission speeds are achieved.

In other words, the first speed and the third speed are achieved by the fore-and-aft shifting of the fifth transmission drive gear m5. The fifth speed and reverse movement are achieved by the fore-and-aft shifting of the third transmission driven gear n3. The second speed and the fourth speed are achieved by the fore-and-aft shifting of the shifter nS. The switching control of the transmission speeds and the control of the first transmission clutch 66 and the second transmission clutch 67 cooperate to transmit the power in the respective transmission speeds.

The front end of the counter shaft 71 projects forwardly from the bearing 72*b*. An output gear 74 is spline-fitted to the front end. The output shaft 80 is disposed downwardly and obliquely rightward of the counter shaft 71 (see FIG. 3). A driven gear 75 spline-fitted to the front portion of the output shaft 80 meshes with the output gear 74 at the front end of the counter shaft 71, so that a power is transmitted from the counter shaft 71 to the output shaft 80.

Since a larger load by the meshing between the output gear 74 and the driven gear 75 of the output shaft 80 is applied to the output gear 74 at the front end of the counter shaft 71, the bearing 72*b* for rotatably supporting the front portion of the counter shaft 71, which is employed here, is relatively large. Therefore, the inner diameter of the bearing opening 72 for fitting the bearing 72*b* of the front wall 31*f* is also large. However, since the bearing recess 62 of the adjacent main shaft 61 is small in diameter as descried before, the strength of the front wall 31*f* of the upper crankcase 31U around the output gear 74 may be maintained at a high level.

A front case cover 85 covers the upper and lower crankcases 31U, 31L configured to be divided into upper and lower halves so as to extend across the partitioning plane on the front surface from which the counter shaft 71 and the output shaft 80 project. A rear case cover 150 covers the upper and lower crankcase 31U, 31L so as to extend across the partitioning plane on the rear surface of the crankcase 31L and covers the fluid coupling 55 at the rear end of the crankshaft 30 and the first and second transmission clutches 66 and 67 at the rear ends of the main shaft 61 via a spacer 110 which also serves partly as a case cover.

The output shaft 80 is configured with a front end borne portion 81 and a rear end borne portion 82, which are formed by casting and are connected by a hollow cylindrical member 83. The front end borne portion 81 is rotatably supported by a bearing opening 86 formed on the front case cover 85 so as to penetrate through the through hole 76*f* formed on the front wall of the lower crankcase 31L via a bearing 86*b* with the front end projecting forward from the front case cover 85. The rear end borne portion 82 is rotatably supported by a bearing opening 111 formed on the spacer 110 so as to penetrate through the through hole 76*r* formed on the rear wall of the lower crankcase 31L via a bearing 111*b* with the rear end projecting rearward from the spacer 110.

In other words, the output shaft 80 is rotatably supported by the front case cover 85 and the spacer 110, with the front end borne portion 81 and the rear end borne portion 82 projecting from the front and rear respectively. In particular, the front through hole 76*f* is adjacent to the front bearing opening 72 of the counter shaft 71. The driven gear 75 is spline-fitted to the front end borne portion 81 adjacently inside a bearing 85*b*.

Therefore, the output gear 74 at the front end of the counter shaft 71 meshes with the driven gear 75 spline-fitted to the front end borne portion 81 of the output shaft 80, so that power is transmitted from the counter shaft 71 to the output shaft 80.

The crankshaft 30 and the counter shaft 71 are rotatably supported on the partitioning plane between the crankcases 31U and 31L oriented in the fore-and-aft direction configured to have the upper and lower halves. Therefore, the main shaft 61 is rotatably supported by the opposed front and rear walls of the upper crankcase 31U, and the crankshaft 30, the main shaft 61 and the counter shaft 71 are arranged at the respective apexes of a triangle. Therefore, the lateral width of the internal combustion engine may be reduced.

The output shaft 80 penetrates through the front and rear walls of the lower crankcase 31L from between the upper and lower crankcases 31U and 31L by which the main shaft 61 is not rotatably supported, is rotatably supported by penetrating through the front case cover 85 and the spacer 110, and projects to the front and rear. Therefore, the shaft support of the crankcase 31 may be dispersed, and hence the shaft support may be achieved desirably without upsizing the internal combustion engine E.

The output shaft 80 is configured with the front end borne portion 81 and the rear end borne portion 82, which are formed by casting and are connected by the hollow cylindrical member 83. Therefore, the weight of the output shaft 80 may be reduced, and a casting apparatus may be downsized in comparison with the case of casting and molding the entire output shaft as in the background art.

On the other hand, a balancer shaft 90 is rotatably supported by being sandwiched on the partitioning plane between the upper and lower crankcases 31U and 31L at a position rightwardly of the crankshaft 30 (see FIG. 3).

Figure 5:
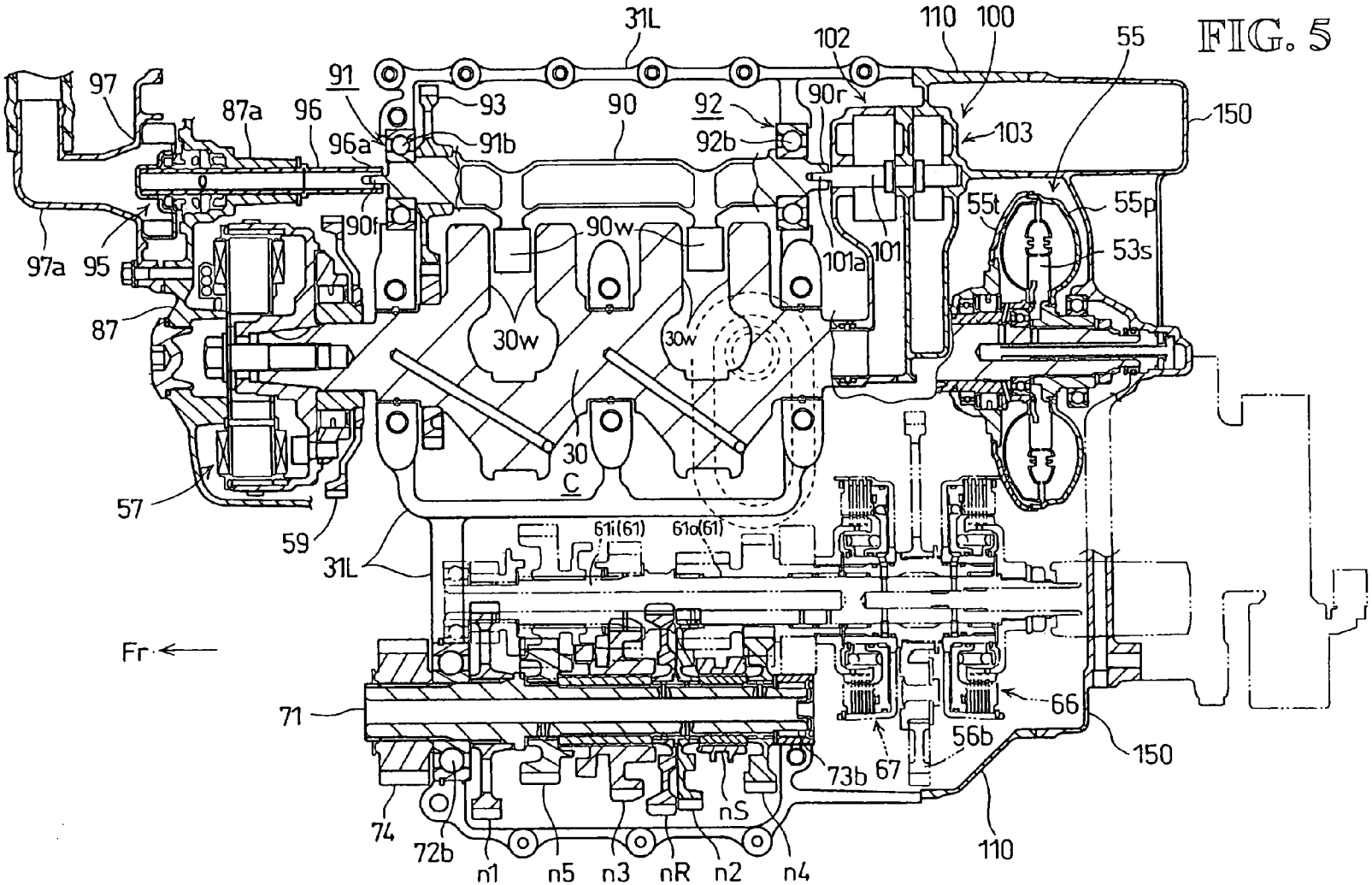
FIG. 5 is a cross-sectional view of the power unit (taken along the lines V-V and V'-V' in FIG. 3)

Referring now to FIG. 5, the balancer shaft 90 is rotatably supported at the front end and the rear end thereof by bearing openings 91 and 92 formed on the front wall and the rear wall of the upper and lower crankcases 31U and 31L via bearings 91*b* and 92*b*, respectively.

The balancer shaft 90 is arranged at a position as close as possible to the crankshaft 30. As shown in FIG. 5, balancer weights 90W of the balancer shaft 90 overlap with (counter weights of) crank webs 30*w* of the crankshaft 30 in the direction of the crankshaft (fore-and-aft direction).

A driven gear 93 is spline-fitted to the bearing 91*b* fitted at the front end of the balancer shaft 90 adjacently inside the bearing 91*b*. The driven gear 93 meshes with the balancer shaft drive gear 54 fitted to the crankshaft 30 so that the rotation of the crankshaft 30 is transmitted to the balancer shaft 90 at the same revolving speed.

Therefore, primary vibrations caused by the reciprocal motion of the pistons 40 are cancelled by the rotation at the same speed as the crankshaft 30 of the balancer shaft 90.

A water pump 95 provided on a front cover member 87 for covering the AC generator 57 or the like from the front is provided forwardly of the balancer shaft 90. A water pump drive shaft 96 rotatably supported by a bearing cylinder 87*a* of the front cover member 87 is arranged coaxially with the balancer shaft 90.

A connecting projection 90*f* projecting forward from the front end of the balancer shaft 90 and a connecting recess 96*a* formed at the rear end of the water pump drive shaft 96 are fitted so that the rotation of the balancer shaft 90 is transmitted to the water pump drive shaft 96 to drive the water pump 95. The front side of the water pump 95 is covered with a water pump cover 97 provided with an intake cylinder 97*a*.

The intake cylinder 97*a* of the water pump cover 97 is connected by the radiator 27 and a water piping arranged on the front side of the vehicle body, so that the water pump 95 sucks cooling water from the radiator 27.

On the other hand, an oil pump unit 100 provided on the spacer 110 is disposed rearwardly of the balancer shaft 90. An oil pump drive shaft 101 that is rotatably supported by the oil pump unit 100 is arranged coaxially with the balancer shaft 90.

A connecting recess 90*r* formed at the rear end of the balancer shaft 90, and a connecting projection 101*a* projecting at the front end of the oil pump drive shaft 101 are fitted, so that the rotation of the balancer shaft 90 is transmitted to the oil pump drive shaft 101 to drive the oil pump unit 100.

A dry sump system is employed for lubrication of the power unit P, and both rotors of a scavenge pump 102 and a feed pump 103 are mounted to the oil pump drive shaft 101 of the oil pump unit 100.

A transmission drive mechanism 200 for performing shift transmission by shifting the shifter of the transmission gear mechanism 60 of the transmission T is provided below the crankshaft 30 and the main shaft 61.

The lower portion of the rear case cover 150 is formed with a gear case portion, which accommodates a speed reduction gear mechanism therein, and is covered by a gear case cover 201 from behind. A transmission power motor 202 is mounted to the right side of the gear case cover 201 from behind. A shift spindle 206 is provided to the lower left portion thereof so as to penetrate through the front case cover 85, the front and rear walls of the lower crankcase 31L and the rear case cover 150. An engaging portion 206*a* formed into the shape of a hexagonal column at the rear end thereof is projected rearward from the gear case cover 201 (see FIG. 3 and FIG. 6).

Provided at the front end of the shift spindle 206 is an angle sensor 207 fixed to the front case cover 85.

A first idle gear shaft 203 and a second idle gear shaft 204 are rotatably supported in the gear case. A small-diameter drive gear 202*a* formed on the motor drive shaft projecting forward from the gear cover 201 of the transmission power motor 202 meshes with a large-diameter gear 203*a* formed integrally with the first idle gear shaft 203. A small-diameter gear 203*b* formed integrally with the first idle gear shaft 203 meshes with the large-diameter gear 204*a* formed integrally with the second idle gear shaft 204. A small-diameter gear 204*b* formed integrally with the second idle gear shaft 204 meshes with a fan-shaped gear shift arm 205 fitted to the shift spindle 206. Therefore, the speed reduction gear mechanism is configured.

Therefore, the drive of the transmission power motor 202 is decelerated via the speed reduction gear mechanism and rotates the shift spindle 206.

A shift drum 210 is rotatably supported obliquely upwardly of the shift spindle 206 between the front and rear walls of the lower crankcase 31L. Shift transmission means 208 is interposed between the shift spindle 206 and the shift drum 210. The rotation of the shift spindle 111 rotates the shift drum 210 via the shift transmission means 208.

Figure 6:
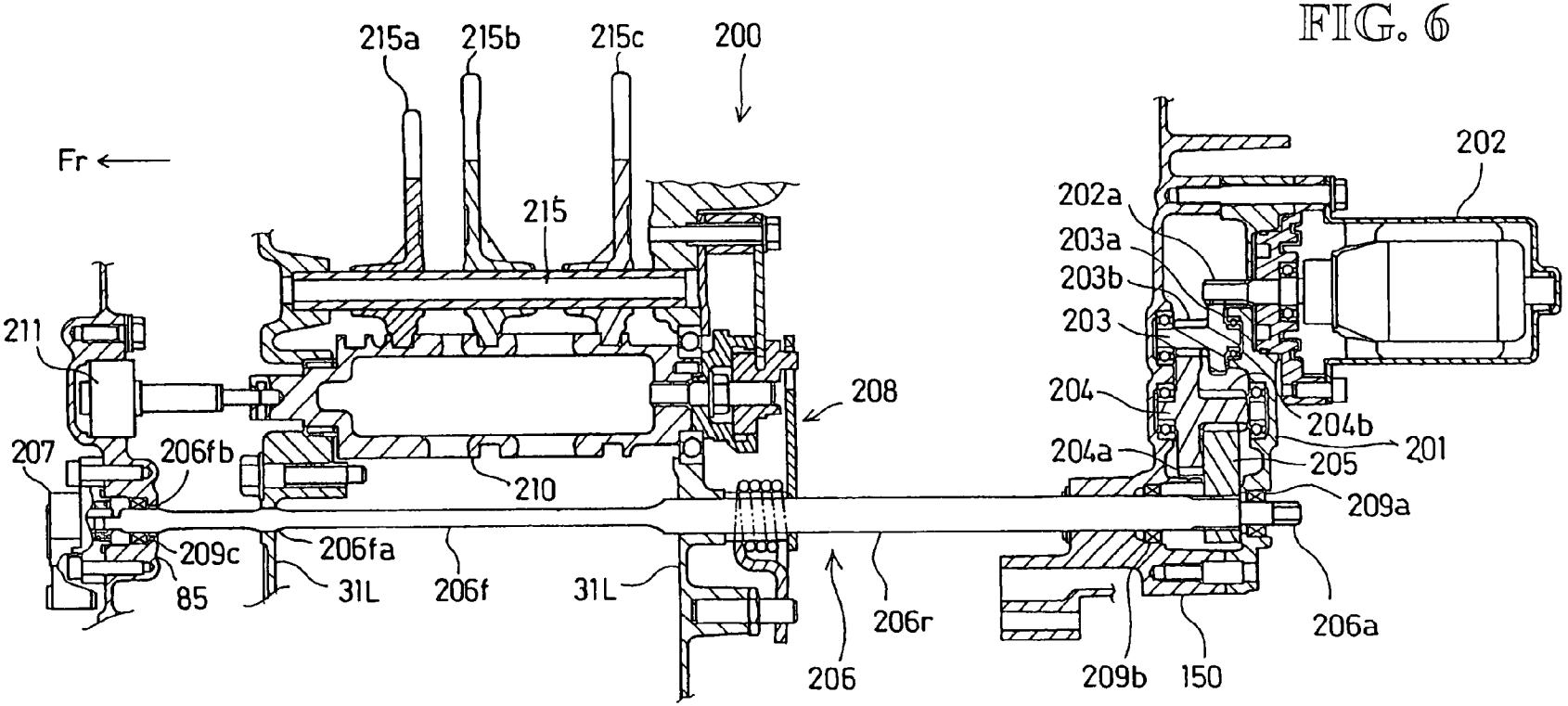
FIG. 6 is a developed cross-sectional view of a transmission drive mechanism.

As shown in FIG. 6, respective shift pins of shift forks 215*a*, 215*b* and 215*c* that are slidably supported by a guide shaft 215 are fitted in three ridges of the shift grooves formed on the outer peripheral surface of the shift drum 210. The shift fork 215*a*, which is guided along the shift groove by the rotation of the shift drum 210 shifting in the axial direction shifts the shifter gear (the fifth transmission drive gear m5) on the main shaft 61. The shift forks 215*b* and 215*c* shift the shifter gear (the third transmission driven gear n3) on the counter shaft 71 and the shifter nS to change the combination of gears to be meshed with each other for shift transmission. The rotational angle of the shift drum 210 is detected by a shift position detector 211 provided in front of the shift drum 210 coaxially therewith.

With the transmission drive mechanism 200 described above, the drive of the transmission power motor 202 rotates the shift spindle 206 via the speed reduction gear mechanism, and the rotation of the shift spindle 206 rotates the shift drum 210 via the shift transmission means 208, so that the shift forks 215*a*, 215*b* and 215*c* are shifted by the rotation of the shift drum 210 for shift transmission.

Then, by engaging an operating portion of a hexagonal hole of a wrench, which is a rotating tool with an engaging portion 111*a* in the shape of the hexagonal column of the shift spindle 206 projected rearward from the gear case cover 201, and rotating the same along the surface of the rear case cover 150, the shift spindle 206 may be rotated to achieve manual shift transmission.

Assembly of the transmission gear mechanism 60 in which the transmission is performed by the transmission drive mechanism 200 as mentioned above will be described below.

Since the counter shaft 71 is rotatably supported on the partitioning plane by being sandwiched between the upper and lower crankcases 31U and 31L, the counter shaft 71 may be assembled by being supported between the semicircular bearing opening 72 and the bearing recess 73 on the partitioning plane of the lower crankcase 31L with the transmission driven gear group assembled to the counter shaft 71, and the bearings 72*b* and 73*b* fitted thereto.

In contrast, since the main shaft 61 is rotatably supported by the bearing recess 62 of the front wall 31*f* and the bearing opening 63 of the rear wall 31*r* in the transmission chamber M of the upper crankcase 31U, assembly of the main shaft 61 is achieved by using the bearing opening 63 having a large inner diameter.

In other words, in a state in which the transmission drive gear group is assembled to the main shaft 61, the rear end of the main shaft 61 is firstly inserted into the bearing opening 63 of the rear wall 31*r* from inside through the opening on the partitioning plane of the transmission chamber M of the upper crankcase 31U. Then, the fourth transmission drive gear m4 at the rear end is inserted through the bearing opening 63 (in the inwardly extending flange 63*f*) having a larger inner diameter, and then the front end of the main shaft 61 is inserted into the transmission chamber M, and is press-fitted into an inner lace of the first bearing 62*b* having an outer lace fitted in advance to the bearing recess 62 of the front wall 31*f* with the shaft center adjusted, so that the front end of the main shaft 61 is rotatably supported.

The second bearing 63*b* is fitted into the bearing opening 63 from behind with the rear portion of the main shaft 61 projected rearward from the bearing opening 63 of the rear wall 31*r* passed therethrough.

At this time, the outer race of the second bearing 63*b* is fitted into the bearing opening 63. At the same time, the inner race is fitted into the outer cylinder 610 of the main shaft 61, whereby the outer cylinder 610 is rotatably supported together with the inner cylinder 61*i*. The second bearing 63*b* is fitted into the bearing opening 63 until it abuts against the inwardly extending flange 63*f*.

In this manner, the main shaft 61 is rotatably supported by the bearing recess 62 of the front wall 31*f* and the bearing opening 63 of the rear wall 31*r* via the first and second bearings 62*b* and 63*b*, a thing in which the first transmission clutch 66 and the second clutch 67 are assembled to the input sleeve 65 and the primary drive gear 56*b* is assembled, is mounted to the portion projecting rearward from the second bearing 63*b* of the main shaft 61, and a nut 69 is screwed into the rear portion of the outer cylinder 61*o* via a washer 68.

As described thus far, the bearing opening 63 for rotatably supporting the rear end of the main shaft 61 via the second bearing 63*b* is formed on the rear wall 31*r* so as to have a larger inner diameter than the fourth transmission drive gear m4 at the rear end on the main shaft 61. Therefore, the bearing opening 63 of the rear wall 31*r* of the upper crankcase 31U is used as an opening for assembling the main shaft 61, so that the main shaft 61 having the transmission gear group assembled thereto may be inserted into the bearing opening 63 to achieve assembly of the main shaft 61 and the assembleability of the main shaft 61 is desirably secured.

Therefore, it is not necessary to use the bearing recess 62 for rotatably supporting the front end of the main shaft 61 via the first bearing 62*b* at one end as the opening for assembling the main shaft and hence the inner diameter may be reduced, and the bearing recess 62 having a small inner diameter for rotatably supporting the front end of the inner cylinder 61*i* of the main shaft 61 having a small diameter is employed. Therefore, even when the bearing opening 72 for rotatably supporting the counter shaft 71 formed in adjacent thereto is formed to have a large diameter for fitting the large bearing 72*b* for resisting a load applied to the output gear 74, the strength of the side wall of the upper crankcase 31U in the periphery of the output gears 74 may be maintained at a high level.

Also, after having assembled the main shaft 61 to the upper crankcase 31U, the pair of transmission clutches 66 and 67 may be assembled to the outer portion of the outer cylinder 61*o* and the outer portion of the inner cylinder 61*i* projecting outward from the upper crankcase 31U, and hence the assembly of the transmission clutches 66 and 67 may be achieved easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankcase structure of an internal combustion engine, comprising:

a crankcase including upper and lower halves;

a crankshaft and a counter shaft rotatably supported on a partitioning plane of the crankcase and oriented in the fore-and-aft direction;

a main shaft oriented in the fore-and-aft direction and rotatably supported on opposed front and rear walls of one of the upper and lower halves of the crankcase; and an output shaft oriented in the fore-and-aft direction to be driven by power of the counter shaft, wherein the output shaft penetrates through the front and rear walls of the other of the upper and lower halves of the crankcase, which does not support the main shaft, and projects to the front and rear.

2. The crankcase structure of an internal combustion engine according to claim 1, further comprising:

a bearing opening for rotatably supporting the counter shaft via a bearing, said bearing opening being formed on one side wall of the crankcase at a position in the proximity of an output member provided at an end of the counter shaft that projects outward from one of the opposed front and rear walls of the crankcase;

a first bearing recess for rotatably supporting one end of the main shaft via a first bearing, said first bearing recess being formed on said one side wall of the crankcase adjacent to the bearing opening for rotatably supporting the counter shaft; and a second bearing recess for rotatably supporting the other end of the main shaft via a second bearing, said second bearing recess being formed on the other side wall of the crankcase, which opposes the one side wall of the crankcase, wherein said second bearing recess has a larger inner diameter than a transmission gear located at an outer most end of the other end of the main shaft.

3. The crankcase structure of an internal combustion engine according to claim 2, wherein the main shaft includes an inner cylinder and an outer cylinder rotatably fitted to a part of the inner cylinder, one end of the inner cylinder is rotatably supported by the first bearing recess on the one side wall via the first bearing, and the other end of the inner cylinder is rotatably supported together with the outer cylinder by the second bearing recess on the other side wall via the second bearing.

4. The crankcase structure of an internal combustion engine according to claim 3, wherein the main shaft is inserted into the second bearing recess on the other side wall of the crankcase, and the one end of the inner cylinder is rotatably supported by the first bearing recess on the one side wall via the first bearing, and the second bearing is fitted between the outer cylinder rotatably fitted to a predetermined position of the inner cylinder and the second bearing recess of the other side wall from the outside, so that the main shaft is assembled.

5. The crankcase structure of an internal combustion engine according to claim 3, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

6. The crankcase structure of an internal combustion engine according to claim 4, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

7. The crankcase structure of an internal combustion engine according to claim 1, further comprising:

a first bearing recess for rotatably supporting one end of the main shaft via a first bearing, said first bearing recess being formed on one side wall of the crankcase; and a second bearing recess for rotatably supporting the other end of the main shaft via a second bearing, said second bearing recess being formed on the other side wall of the crankcase, which opposes the one side wall of the crankcase, wherein said second bearing recess has a larger inner diameter than a transmission gear located at an outer most end of the other end of the main shaft.

8. The crankcase structure of an internal combustion engine according to claim 7, wherein the main shaft includes an inner cylinder and an outer cylinder rotatably fitted to a part of the inner cylinder, one end of the inner cylinder is rotatably supported by the first bearing recess on the one side wall via the first bearing, and the other end of the inner cylinder is rotatably supported together with the outer cylinder by the second bearing recess on the other side wall via the second bearing.

9. The crankcase structure of an internal combustion engine according to claim 8, wherein the main shaft is inserted into the second bearing recess on the other side wall of the crankcase, and the one end of the inner cylinder is rotatably supported by the first bearing recess on the one side wall via the first bearing, and the second bearing is fitted between the outer cylinder rotatably fitted to a predetermined position of the inner cylinder and the second bearing recess of the other side wall from the outside, so that the main shaft is assembled.

10. The crankcase structure of an internal combustion engine according to claim 9, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

11. A crankcase structure of an internal combustion engine, comprising:

a crankcase including upper and lower halves;

a main shaft rotatably supported on one of the upper and lower halves of the crankcase; and an output shaft, said output shaft penetrating the other of the upper and lower halves of the crankcase.

12. The crankcase structure of an internal combustion engine according to claim 11, further comprising:

a bearing opening for rotatably supporting a counter shaft via a bearing, said bearing opening being formed on one side wall of the crankcase at a position in the proximity of an output member provided at an end of the counter shaft that projects outward from one of opposed front and rear walls of the crankcase;

a first bearing recess for rotatably supporting one end of the main shaft via a first bearing, said first bearing recess being formed on said one side wall of the crankcase adjacent to the bearing opening for rotatably supporting the counter shaft; and a second bearing recess for rotatably supporting the other end of the main shaft via a second bearing, said second bearing recess being formed on the other side wall of the crankcase, wherein said second bearing recess has a larger inner diameter than a transmission gear located at an outer most end of the other end of the main shaft.

13. The crankcase structure of an internal combustion engine according to claim 12, wherein the main shaft includes an inner cylinder and an outer cylinder rotatably fitted to a part of the inner cylinder, one end of the inner cylinder is rotatably supported by the first bearing recess on the one side wall via the first bearing, and the other end of the inner cylinder is rotatably supported together with the outer cylinder by the second bearing recess on the other side wall via the second bearing.

14. The crankcase structure of an internal combustion engine according to claim 13, wherein the main shaft is inserted into the second bearing recess on the other side wall of the crankcase, and the one end of the inner cylinder is rotatably supported by the first bearing recess on the one side wall via the first bearing, and the second bearing is fitted between the outer cylinder rotatably fitted to a predetermined position of the inner cylinder and the second bearing recess of the other side wall from the outside, so that the main shaft is assembled.

15. The crankcase structure of an internal combustion engine according to claim 13, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

16. The crankcase structure of an internal combustion engine according to claim 14, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

17. The crankcase structure of an internal combustion engine according to claim 11, further comprising:

a first bearing recess for rotatably supporting one end of the main shaft via a first bearing, said first bearing recess being formed on one side wall of the crankcase; and a second bearing recess for rotatably supporting the other end of the main shaft via a second bearing, said second bearing recess being formed on the other side wall of the crankcase, which opposes the one side wall of the crankcase, wherein said second bearing recess has a larger inner diameter than a transmission gear located at an outer most end of the other end of the main shaft.

18. The crankcase structure of an internal combustion engine according to claim 17, wherein the main shaft includes an inner cylinder and an outer cylinder rotatably fitted to a part of the inner cylinder, one end of the inner cylinder is rotatably supported by the first bearing recess on the one side wall via the first bearing, and the other end of the inner cylinder is rotatably supported together with the outer cylinder by the second bearing recess on the other side wall via the second bearing.

19. The crankcase structure of an internal combustion engine according to claim 18, wherein the main shaft is inserted into the second bearing recess on the other side wall of the crankcase, and the one end of the inner cylinder is rotatably supported by the first bearing recess on the one side wall via the first bearing, and the second bearing is fitted between the outer cylinder rotatably fitted to a predetermined position of the inner cylinder and the second bearing recess of the other side wall from the outside, so that the main shaft is assembled.

20. The crankcase structure of an internal combustion engine according to claim 19, wherein a pair of transmission clutches for controlling transmission of power to the outer cylinder and the inner cylinder, respectively, are assembled respectively to the outside portion of the outer cylinder that projects outward from the second bearing recess of the other side wall and the outside portion of the inner cylinder that projects further outward from the outer cylinder.

* * * * *